US005661627A

United States Patent [19]

Liebetruth et al.

[11] Patent Number: 5,661,627

[45] Date of Patent: Aug. 26, 1997

[54] ARRANGEMENT FOR CONTROLLING THE SWITCHING OF A POWER CIRCUIT BREAKER

[75] Inventors: Marc Liebetruth; Ulrich Marquardt; Guenter Prietzel, all of Berlin, Germany

[73] Assignee: Siemens Aktiengesellschaft, München, Germany

[21] Appl. No.: 619,677

[22] PCT Filed: Sep. 16, 1994

[86] PCT No.: PCT/DE94/01108

§ 371 Date: May 24, 1996

§ 102(e) Date: May 24, 1996

[87] PCT Pub. No.: WO95/09429

PCT Pub. Date: Apr. 6, 1995

[30] Foreign Application Priority Data

Sep. 30, 1993 [DE] Germany ..... 43 33 828.3

[51] Int. Cl.[6] ..... H01H 73/00

[52] U.S. Cl. ..... 361/115; 335/17; 200/401

[58] Field of Search ..... 361/115; 335/17; 200/400, 401

[56] References Cited

U.S. PATENT DOCUMENTS

| | | | |
|---|---|---|---|
| 2,640,122 | 5/1953 | Oppel et al. | 335/21 |
| 3,198,906 | 8/1965 | Frink et al. | 335/25 |
| 3,875,360 | 4/1975 | Rys | 200/400 |
| 4,506,246 | 3/1985 | Wong | 335/164 |

FOREIGN PATENT DOCUMENTS

| | | |
|---|---|---|
| 1 574 048 | 7/1969 | France . |
| 1 153 440 | 8/1963 | Germany . |
| 3 806 370 | 9/1989 | Germany . |
| 1 288 595 | 9/1972 | United Kingdom . |

*Primary Examiner*—Jeffrey A. Gaffin
*Assistant Examiner*—Sally C. Medley
*Attorney, Agent, or Firm*—Kenyon & Kenyon

[57] ABSTRACT

A power circuit breaker (1) is provided with an arrangement that controls its switching-on depending on operating parameters (A . . . E, M1, M2, S). These parameters may be, for example, the position of switching contacts, the state of excitation of an undervoltage release and the switching position of another power circuit breaker. The arrangement has a coupling shaft (32) that may be rotated by a tripping half-wave by means of a steering lever (34) and by certain parameters by means of a sensor lever (36). A coupling member (20) that may be swivelled by the coupling shaft (32) allows a ratchet device (5, 6) of the energy store (7) of the power circuit breaker (1) to be released only when all conditions required for switching-on are met.

10 Claims, 3 Drawing Sheets

ARRANGEMENT FOR CONTROLLING THE SWITCHING OF A POWER CIRCUIT BREAKER

FIELD OF THE INVENTION

The present invention relates to a device for controlling the switching-on of a power circuit breaker as a function of at least one operating parameter.

BACKGROUND INFORMATION

French Patent Document No. 1 574 048 A describes a device for controlling the switching of a power circuit breaker as a function of one or more operating parameters. As described therein, the operating parameters are the switch position of the power circuit breaker and the state of the energy store. A switch-on command is made ineffective by the coupling member if the switching contacts are closed and the energy store is loaded. This is a means of preventing the switching mechanism of the power circuit breaker from being stressed unnecessarily through no-load switching and so-called pumping and the lifespan of the power circuit breaker being negatively influenced as a result.

SUMMARY OF THE INVENTION

The present invention provides a device for controlling the switching-on of a power circuit breaker as a function of at least one operating parameter, which power circuit breaker has switching contacts which are movable relative to one another and, for actuating the switching contacts, an energy store as well as a ratchet device by way of which the energy store can be latched in the loaded state and which can be released manually or under remote control. The operating parameter as well as an "ON" command are each present in the form of a mechanical movement. The switching contacts are transferrable from the closed state through actuation of a tripping latch to the open state, and the ratchet device has a coupling member which can be acted upon by the operating parameter in order to make the "ON" command ineffective. An object of the present invention is to provide a device of the aforementioned type such that further operating parameters desired for reliable operation of the power circuit breaker can likewise be taken into account without the device entailing a significantly increased cost or its reliability being impaired.

The aforementioned objective is solved according to the present invention by the following further features: 1) the coupling member can be actuated by a coupling shaft, 2) the coupling shaft can be acted upon by the at least one operating parameter, and 3) for reporting the readiness of the power circuit breaker to switch on, an indicator member can be actuated depending on the position of the coupling shaft such that the readiness of the power circuit breaker to switch on is signalled only for a taut energy store and a coupling shaft which is not actuated.

The coupling shaft offers an advantageous possibility to take into account any influences, e.g., the lack of a trip element to be inserted as an assembly into the power circuit breaker, or the lacking excitation of an undervoltage release. Whenever a state exists due to which the switching-on of the power circuit breaker is to be prevented, the coupling shaft brings the coupling member out of engagement with the ratchet device. An "ON" command, no matter whether it is given manually or by an electromagnet, then has no effect. This state is brought directly to the attention of the user of the power circuit breaker by the indicator member.

An advantageous exemplary embodiment of the present invention includes the following features:

- the ratchet device has a locking shaft and a catch peg joined to the locking shaft,
- the coupling member has a coupling lever which can be swivelled about a hinged bearing, which coupling lever is provided with a coupling peg gripping the catch peg,
- the hinged bearing is located on a swivelably supported lever mount which can be actuated by an "ON" command, an actuation of the lever mount corresponding to a displacement of the hinged bearing of the coupling lever in the sense of a rotation of the locking shaft for releasing the energy store, and
- the lever can be swivelled about its hinged bearing by the coupling shaft in order to bring the coupling peg into or out of engagement with the catch peg.

The coupling shaft can be provided with one or more sensor levers which are used for sensing operating parameters arising inside or outside of the power circuit breaker, these parameters possibly being, in particular, "Position of the switching contacts of the power circuit breaker", "Presence of an overcurrent trip", "Switch position of at least one further power circuit breaker", "Position of the door of a switchgear cell accommodating the power circuit breaker" and "State of the travelling mechanism of the power circuit breaker in a slide-in mount".

In any case, a lack of readiness to switch on should be signalled if a tripping command is present. This can be achieved in that a tripping half-wave belonging to the switch-off latch has a cantilever and that the coupling shaft supports a steering lever which interacts with the cantilever such that when the tripping half-wave is acted upon in the tripping sense, the coupling shaft is also rotated in order to bring the coupling peg out of engagement with the catch peg. It is achieved with this arrangement that all members provided for tripping the power circuit breaker also cause at the same time the message or rather indication "Not ready to switch on". In particular, the parameter "Lacking excitation of an undervoltage release" can be supplied to the tripping half-wave.

In the device according to the present invention, the prevention of no-load switching and pumping, mentioned above, can be implemented in a particularly simple manner in that as a corresponding operating parameter the position of an actuating shaft actuating the switching contacts can be supplied to the coupling shaft, for example, using a sensor lever of the type mentioned above. In power circuit breakers which have instead of an actuating shaft an insulating crossbeam connecting the switching contact arrangements, the position of the insulating crossbeam can be used analogously as a parameter.

The readiness of the power circuit breaker to switch on can likewise be indicated mechanically automatically. Within the scope of the present invention, for reporting the readiness of the power circuit breaker to switch on, a movement dependent on the position of the coupling member and the state of the energy store can be supplied to a mechanical AND element which carries or actuates the indicator member. A reporting switch can be connected to this AND element or rather to the display member.

Instead of a separate AND element for indicating the readiness to switch on, a parameter dependent on the state of load of the energy store can likewise be supplied to the coupling shaft, the position of the coupling shaft or rather the coupling member controlled by it being used directly for indication of the readiness to switch on.

The coupling member offers the possibility, besides the manual introduction of a switch-on command, also to process an "ON" command transmitted by remote control. This can take place in that the coupling member has an additional working surface which is effective only in the coupled state for introducing a parameter "State of a polling magnet".

DETAILED DESCRIPTION

Figure 1:
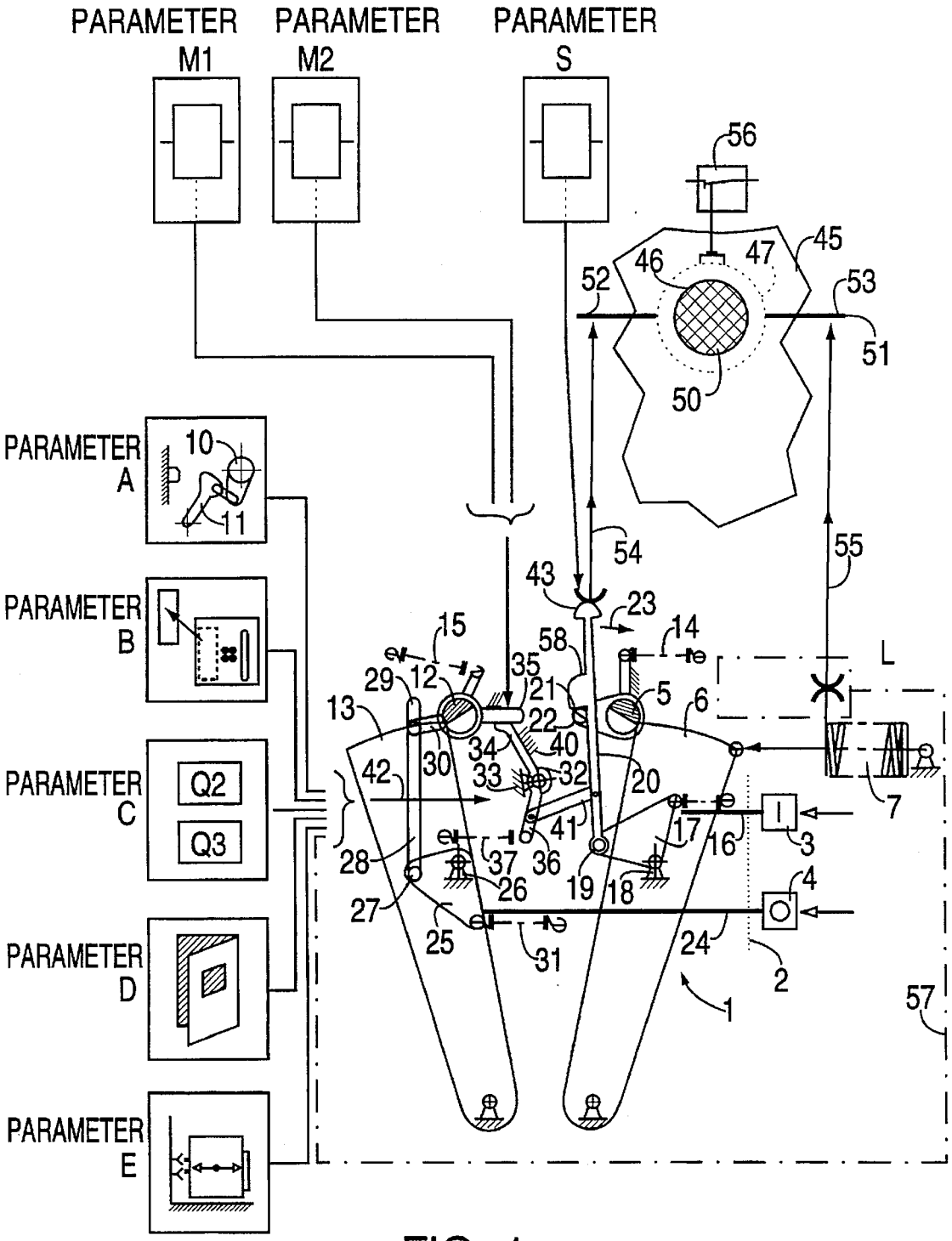
FIG. 1 schematically depicts parts of a power circuit breaker in a "Ready to switch on" state. Operating parameters are indicated in the form of functional blocks.

In FIG. 1, components of a power circuit breaker 1 are shown schematically along with a number of internal and external peripheral devices. An operator's console 2 is shown with a push-button 3 for switch-on and a push-button 4 for switch-off. The push-button 3 interacts with a ratchet device which comprises a switch-on half-wave 5 which is rotatably supported in supports not shown, and a switch-on latch 6. The switch-on latch 6 is arranged in the course of a mechanical load transmission, which leads from an energy store 7 to an actuating shaft 10 and from there to one or more switching contacts 11.

The push-button 4 controls a likewise rotatably supported tripping half-wave 12 on which a switch-off latch 13 is braced. The switch-on half-wave 5 and the tripping half-wave 12 are prestressed in the rest state by extension springs 14 and 15, respectively, in their latching position.

The push-button 3 is joined by way of a switch-on impacting rod 16 with a lever mount 17 which is movable about a stationary hinged bearing 18 and which has the function of an angle lever. Moreover, a coupling member 20 is mounted flexibly by a support 19 on the lever mount 17, which coupling member 20 is provided with a coupling peg 21 for a catch peg 22 acting on the switch-on half-wave 5. By swivelling the lever-like coupling member 20, in a manner to be described below, about its support 19 located on the lever mount 17, the coupling peg 21 can be swivelled out of the position shown in FIG. 1 and thereby the coupling peg 21 brought out of engagement with the catch peg 22. The coupling member 20 allows a rotation of the switch-on half-wave 5 only in the position according to FIG. 1. If the coupling member 20 is swivelled in the direction of the arrow 23 about its support 19, then an actuation of the push-button 3 has no effect.

The actuation of the tripping half-wave 12 by the push-button 4 takes place via a switch-off impacting rod 24, an angle-lever-like rod support 25 with a hinged bearing 26 and a catch rod 28 which is joined to the rod support 25 through a swivel joint 27. The catch rod 28 grips the tripping half-wave 12 with a slotted hole 29 or an equivalently acting arrangement via a catch 30. The shown position of rest of the rod support 25 is maintained through an extension spring 31.

The coupling member 20 can be actuated by a coupling shaft 32 which is mounted below and between the switch-on half-wave 5 and the tripping half-wave 12 in a stationary support 33. The coupling shaft 32 is provided with a steering lever 34 which interacts with a cantilever 35 of the tripping half-wave 12. A sensor lever 36 of the coupling shaft 32 is prestressed by an extension spring 37 in its shown position of rest in which the steering lever 34 abuts against a stationary stop 40. Moreover, a coupling rod 41 is pivoted on the cantilever 36 for joining with the lever 20. The coupling member 20 can thus be swivelled out of its coupling position shown in FIG. 1 in the direction of the arrow 23 through a rotation of the coupling shaft 32 occurring in the counterclockwise direction. Through an arrangement of the coupling rod 41 running more or less perpendicular to the coupling member 20, it is ensured that a displacement of the coupling member 20 by means of the push-button 3 and the lever mount 17 can take place without hindrance.

The coupling shaft 32 can have a number of operating parameters applied to it, which act as a mechanical movement in the direction of an arrow 42 shown in FIG. 1. In FIG. 1, operating parameters A, B, C, D and E are shown, which are explained below.

The parameter A signals the position of the actuating shaft 10 and thus the position of the switching contacts 11. This feature is essential for the enabling or rather disabling of the switch-on since an enabling of the energy store 7 with closed switching contacts 11 can lead to damage due to the lack of energy requirement on the part of the switching mechanism.

Parameter B means "Overcurrent trip missing" and signals that the tripping block which is essential for the protective function of the power circuit breaker 1 has not been connected to the power circuit breaker 1 in the provided manner such that it cannot perform its protective function.

The parameter C contains the reporting of the position of other power circuit breakers, with respect to which the operation of the power circuit breaker 1 is to be locked. This dependency can exist for one or more further power circuit breakers. In FIG. 1, the locking with respect to two further power circuit breakers Q2 and Q3 is shown, whose switching position can be supplied to the coupling shaft 32.

The position of the door of the switchgear cell in which the power circuit breaker 1 is located, which position is important for the safety of the operating personnel, is reported by the parameter D. If the door is open, then the coupling shaft 32 is actuated likewise.

If the power circuit breaker is arranged movably on a slide-in unit, then the position of the power circuit breaker in the slide-in mount is also essential for the decision as to whether switch-on can occur or not. In intermediate positions, e.g., outside of the separation position, the test position and the operating position, it should not be possible to switch on the power circuit breaker 1. In these cases as well, through a corresponding rotation of the coupling shaft 32 in the counterclockwise direction, the coupling lever 20 is decoupled from the switch-on half-wave 5 in the direction of the arrow 23.

The described parameters A and B belong to the power circuit breaker 1 and are thus "internal" parameters, whereas the parameters C, D and E represent "external" signals, i.e., signals to be supplied from outside of the power circuit breaker 1. In a known manner, such signals can be supplied through lever systems or rather cable lines or similar means, even following multiple rerouting, to the power circuit breaker.

Besides the parameters explained above, there are further parameters which represent an additional function per se for tripping devices serving the power circuit breaker. In particular, this applies to an undervoltage release generally provided. If it is not excited due to the lack of a sufficient voltage, then the power circuit breaker cannot be switched on. The parameter M1 shown in the figures "State of the undervoltage release" should then cause the indication "Not ready to switch on" For this purpose, the undervoltage release acts in a suitable manner upon the tripping half-wave 12 whose cantilever 35 actuates the coupling shaft by means of the steering lever 34 like one of the parameters A to E. Moreover, the cantilever 35 is to be actuated by further parameters, particularly by a parameter M2, which designates the state of a tripping magnet, which is triggered by an overcurrent trip.

The position of the coupling member 20 signals basically the readiness of the power circuit breaker 1 to switch on. This characteristic is used in order to take into account a further parameter S, "State of excitation of the polling magnet". This takes place using a working surface 43 at the upper end of the coupling member, which stands opposite to an impacting rod or other actuating member of the polling magnet only in the ready-to-switch-on position according to FIG. 1.

Besides the previously named parameters A . . . E as well as M1 and M2, the loading state L of the energy store 7 is also incorporated into the indication and optionally into the signalling of the readiness of the power circuit breaker 1 to switch on. This takes place in a manner such that the loading state and the position of the coupling member 20 control the indication of the readiness to switch on along the lines of an AND operation.

An example for the formation of an AND operation for the readiness-to-switch-on indication is shown in the right upper area of the figures. Behind a viewing window 46 situated on the partially shown front side 45 of the power circuit breaker 1, an indicator member 47 is arranged swivellably and movably, which has a viewing area 50 provided with a corresponding labelling or other suitable designation. The indicator member is attached to an actuating bar 51 which protrudes on both sides, whose left section 52 is joined to the coupling member 20 and whose right section 53 is coupled to the energy store 7 through transfer elements 54 and 55, respectively.

In FIG. 1, the state "Ready to switch on" is shown in which the transfer elements 54 and 55 are actuated so that the indicator member 47 is pressed upwards and the viewing area 50 behind the viewing window 46 appears as a result. A reporting switch 56 is likewise actuated accordingly and is able to also signal electrically the readiness to switch on.

Figure 2:
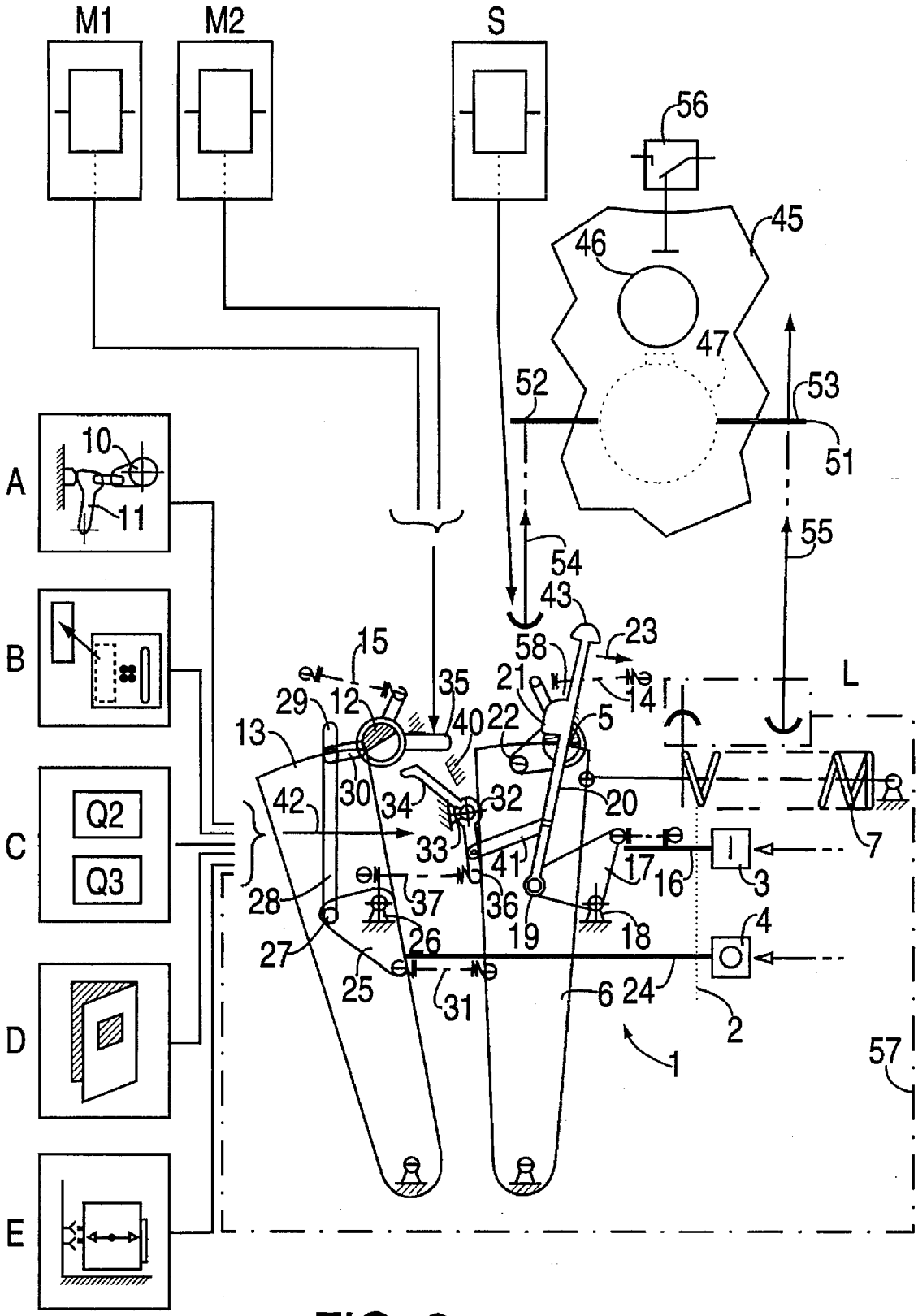
FIG. 2 shows the arrangement according to FIG. 1 in a "Not ready to switch on" state due to closed switching contacts and an energy store which is not loaded.

FIG. 2 shows, based on a representation corresponding to FIG. 1, the state in which the switching contacts 11 are closed and by means of the parameter A the coupling shaft 32 is actuated. The coupling member 20 is swivelled in the direction of the arrow 23 by the coupling rod 41 and the coupling peg 21 is not engaged with the catch peg 22. As a result, the left section 52 of the actuating bar 51 is located in the depressed rest state. The right section 53 is likewise depressed since the energy store 7 is unloaded. The indicator member 47 is now located below the viewing window 46.

Figure 3:
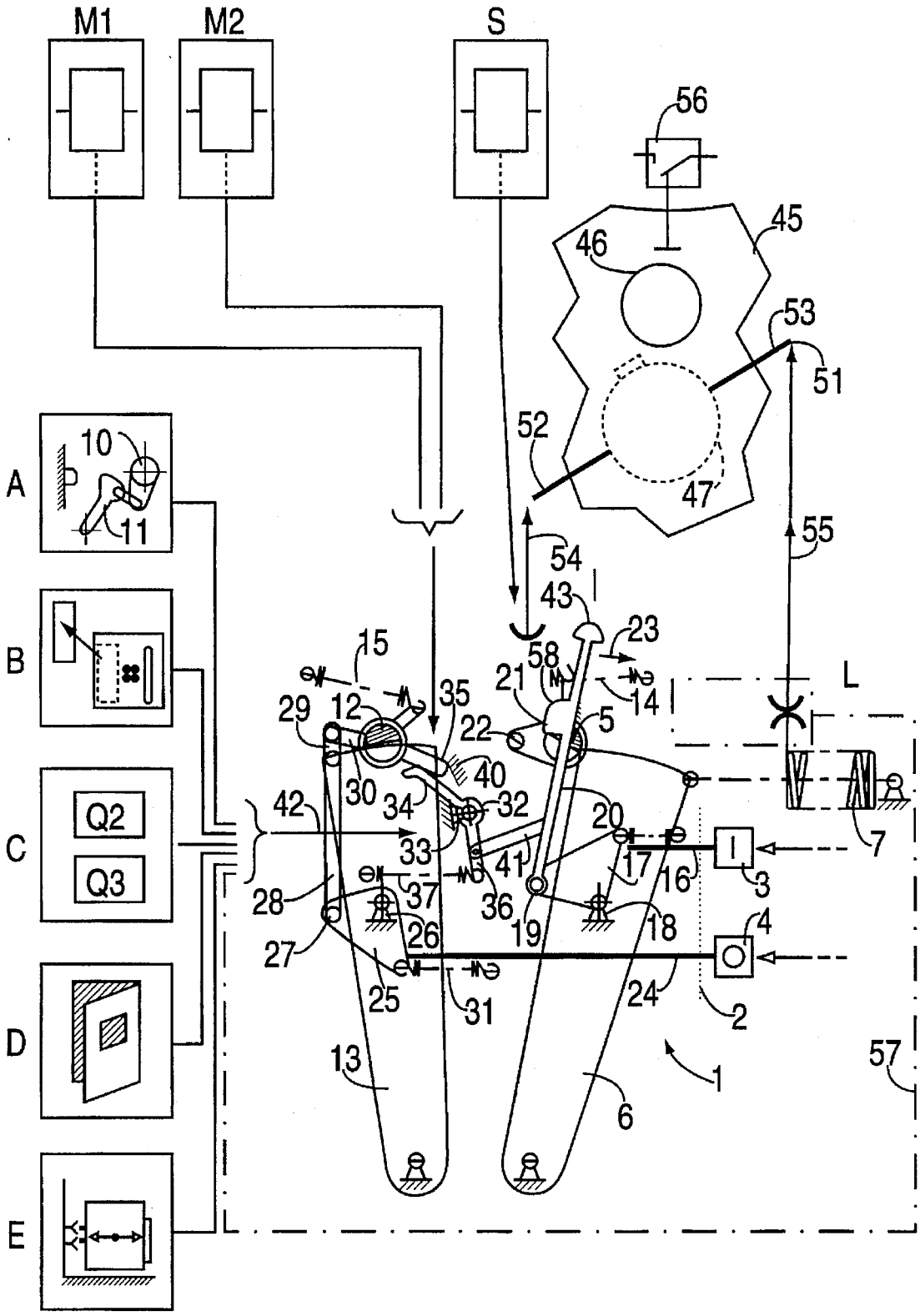
In FIG. 3, the device according to FIG. 1 is likewise in the state "Not ready to switch on" due to a lack of excitation of the undervoltage release.

In FIG. 3, the state is shown in which the tripping half-wave 12 is actuated either by actuating the push-button 4 or by one of the previously explained parameters and as a result the coupling shaft 32 is turned in the counterclockwise sense. The coupling member 20 is thus swivelled to the right and the coupling peg 21 is not engaged with the catch peg 22. As a result, the support by the working surface on the coupling member 20 is removed from the left transfer element 54 and the left section 52 of the actuating bar 51 is depressed. In contrast, the right section 53 is raised since the energy store 7 is taut. The indicator member 47 thus carries out only one rotation, but does not reach into the area of the viewing window 46.

Instead of the described separate AND operation in the area of the indicator member 47, a direct indication of the readiness to switch on can take place through the position of the coupling shaft 32 or rather the coupling member 20 if the loading state of the energy store 7 is supplied to the sensor lever 36 as further parameter L. This is represented in FIG. 1 by a dot-dash line of action 57.

As the figures also show, the coupling peg 21 of the coupling member 20 has only one working surface for the interaction with the catch peg 22. Through an upper blocking surface 58, it is avoided that the two pegs can become engaged in an undesired position and thus cause a disruption to the operation of the device.

We claim:

1. A power circuit breaker device comprising:

a plurality of switching contacts which are movable relative to one another;

an energy store for actuating the switching contacts;

a ratchet device for latching the energy store in a loaded state, the ratchet device being releasable manually or under remote control and including a coupling member which can be acted upon by at least one mechanical movement indicative of at least one operating parameter in order to disable an on command;

a tripping latch for transferring the switching contacts from a closed state to an open state;

a coupling shaft for actuating the coupling member of the ratchet device, the coupling shaft being acted upon by at least one mechanical movement indicative of the at least one operating parameter; and an indicator member for indicating a readiness of the power circuit breaker to switch on, the indicator member being actuatable depending on a position of the coupling shaft such that the readiness of the power circuit breaker to switch on is indicated only when the energy store is in a taut state and the coupling shaft is not actuated.

2. The device according to claim 1, wherein:

the ratchet device includes a switch-on half-wave and a catch peg coupled to the switch-on half-wave, the coupling member is movable about a hinged bearing and includes a coupling peg which engages the catch peg, the hinged bearing being located on a swivelably supported lever mount which is actuatable by an on command, an actuation of the lever mount corresponding to a displacement of the hinged bearing of the coupling member in the sense of a rotation of the switch-on half-wave for releasing the energy store, and the coupling member can be swivelled about the hinged bearing by the coupling shaft in order to bring the coupling peg into or out of engagement with the catch peg.

3. The device according to claim 2, wherein:

the tripping latch includes a tripping half-wave and a cantilever attached to the tripping half-wave, and the coupling shaft supports a steering lever which interacts with the cantilever so that when the tripping half-wave is acted upon in a tripping sense, the coupling shaft is rotated in order to bring the coupling peg out of engagement with the catch peg.

4. The device according to claim 3, wherein an operating parameter indicative of a state of excitation of an undervoltage release is supplied to the tripping half-wave.

5. The device according to claim 1, wherein the coupling shaft includes at least one sensor lever for sensing the at least one operating parameter.

6. The device according to claim 5 wherein the at least one operating parameter includes at least one operating parameter selected from the group consisting of a position of the switching contacts, an existence of an overcurrent trip, a switch position of at least one further power circuit breaker, a position of a door of a switchgear cell accommodating the power circuit breaker and a state of a travelling mechanism of the power circuit breaker in a slide-in mount.

7. The device according to claim 5, wherein an operating parameter indicative of a position of an actuating shaft actuating the switching contacts is supplied to the coupling shaft.

8. The device according to claim 1, wherein a movement dependent on the position of the coupling member and the state of the energy store is supplied to a mechanical AND element which actuates the indicator member for indicating the readiness of the power circuit breaker to switch on.

9. The device according to claim 1, wherein an operating parameter indicative of the loading state of the energy store is supplied to the coupling shaft and wherein the position of at least one of the coupling shaft and the coupling member indicates the readiness of the power circuit breaker to switch on.

10. The device according to claim 1, wherein the coupling member includes an additional working surface which is effective only in a coupled state for sensing a parameter indicative of a state of a polling magnet.

* * * * *